US007390247B2

(12) United States Patent
Lai

(10) Patent No.: US 7,390,247 B2
(45) Date of Patent: Jun. 24, 2008

(54) CHOPSTICKS STRUCTURE

(76) Inventor: Yin-Chu Lai, 378 Pao Bou Rd., Changhua (TW)

( * ) Notice: Subject to any disclaimer, the term of this patent is extended or adjusted under 35 U.S.C. 154(b) by 0 days.

(21) Appl. No.: 11/232,937

(22) Filed: Sep. 23, 2005

(65) Prior Publication Data

US 2007/0080552 A1 Apr. 12, 2007

(51) Int. Cl.
*A22B 5/00* (2006.01)

(52) U.S. Cl. ..... 452/174

(58) Field of Classification Search ..... 452/198
See application file for complete search history.

(56) References Cited

U.S. PATENT DOCUMENTS 4,955,401 A * 9/1990 Parsons ..... 132/262
5,373,640 A * 12/1994 Cordeiro, Jr. ..... 30/142
D539,615 S * 4/2007 Weaver ..... D7/643

* cited by examiner

*Primary Examiner*—Thomas Price
(74) *Attorney, Agent, or Firm*—Troxell Law Office, PLLC

(57) ABSTRACT

A chopsticks structure, comprises a holding part and a clipping part, wherein the outer peripheral surface of said clipping part raises outwardly toward the tail end to form an elevation angle preferably in the range of 3-10 degree, such that, during clipping foods, the fulcrum of the holding force can be increased so as to favor the clipping of the food. Further, when said clipping part is configured as a tetragonal column, the contact between said clipping part and the food can be a linear or facial contact, such that the user can clip and hold securely food having smooth surface.

6 Claims, 7 Drawing Sheets

CHOPSTICKS STRUCTURE

BACKGROUND OF THE INVENTION

1. Field of the Invention

The invention relates to a chopsticks structure, and more particular, to a chopsticks structure characterized in that an angle is present outwardly toward the tail end along the outer peripheral surface of its clipping part so as to increase the fulcrum and contact area for the holding force during clipping food with its clipping part to facilitate the holding of food.

2. Description of the Prior Art

As shown in FIG. 8, conventional chopsticks is generally in a thin and elongated form, and consists mainly of a holding part a for being manipulated with a single hand, and a clipping part a1 for clipping food, wherein the surface of said clipping part a1 is relatively smooth. When a user clips food, the conventional chopsticks works well with respect to common cooked food, however, to foods of smooth surface (for example, egg, peanut), since the friction force between the clipping part a1 of the chopsticks and the food is insufficient to hold the food, the food tends to slide off and fall down (as shown in FIG. 9).

In order to solve this problem, manufacturers had provided a thread-like portion on the periphery of clipping part b (as shown in FIG. 10) in an attempt to increase the friction force between the clipping part b and food. Although this structure can solve the problem of uneasiness of clipping food of smooth surface to some extent, this type of chopsticks is not easy to clean and tends to breed bacteria.

Another conventional modified chopsticks structure, as shown in FIG. 11, comprises of a clipping part c processed into an arc shape in an attempt to increase the contact and supporting points between the clipping part c and the clipped food so as to facilitate holding the food. Theoretically, this structure can achieve effectively the effect of holding food, however, in practical use, various effects may be attained depending on sizes of foods.

Referring to FIG. 12, when a user clips a bulky and smooth egg type food (such as a cooked hen's egg) with such conventional chopsticks, the surface of this clipping part c will contacts with the surface of the cooked egg at point A and B, respectively, and hence can clip the cooked egg easily. Nevertheless, as shown in FIG. 13, in clipping a cooked bird's egg or bean food having a less size and smooth surface, the clipping part c of the above-described conventional chopsticks contacts the cooked bird's egg or bean food at only a single point (A1) and hence can achieve a holding effect only with no difference from that attained by the above-described chopsticks having a smooth clipping part a1, namely, the purpose of clipping food effectively can not be achieved.

Further, since said clipping part c is processed into geometry of an arc body, and mainly an ellipsoid form, when the user clips downwardly to the food, on end of the longitudinal axis of the ellipsoid will contact first the surface of the dish containing the food, and hence forms a height H with the recess portion of the clipping part, it would not be easy to clip food in practical use, unless the food is stacked high enough.

In view of these and in order to improve the above-mentioned disadvantages so as to increase the fulcrum of the holding force and the contact area of the clipping part with the food during clipping food to facilitate clipping of food with large or small size, the inventor had studied and developed constantly and intensively, and finally, accomplished the invention.

SUMMARY OF THE INVENTION

One objective of the invention is to provide a chopsticks structure characterized in that, by raising its tail end outwardly so as to form an angle, the fulcrum of the holding force can be increased during clipping a food to facilitate clipping.

Another objective of the invention is to provide chopsticks structure characterized in that, by configuring the clipping part into a tetragonal column structure, the contact area between its holding part and the food can be increased for clipping food securely.

In order to achieve the above-mentioned objectives, the invention provides a chopsticks structure consisted of a holding part and a clipping part. Such chopsticks structure has following technical characteristics: said clipping part has its outer periphery raising outwardly toward its tail end and forming an angle of 1-45 degree, preferably, an elevation angle of 3-10 degree, such that, during clipping a food, it can enclose inwardly the food from the outer side and increase the fulcrum of the holding force to favor clipping of the food.

In practice, the clipping part of the chopsticks structure according to the invention may be configured as tetragonal column or cylinder. When the clipping part is a tetragonal column, the linear or facial contact with the food enables its user to clip food securely.

BRIEF DESCRIPTION OF THE DRAWINGS

These features and advantages of the present invention will be fully understood and appreciated from the following detailed description of the accompanying drawings.

In order to better understand the invention, a detailed description is provided below.

DETAILED DESCRIPTION OF THE PREFERRED EMBODIMENT

Figure 1:
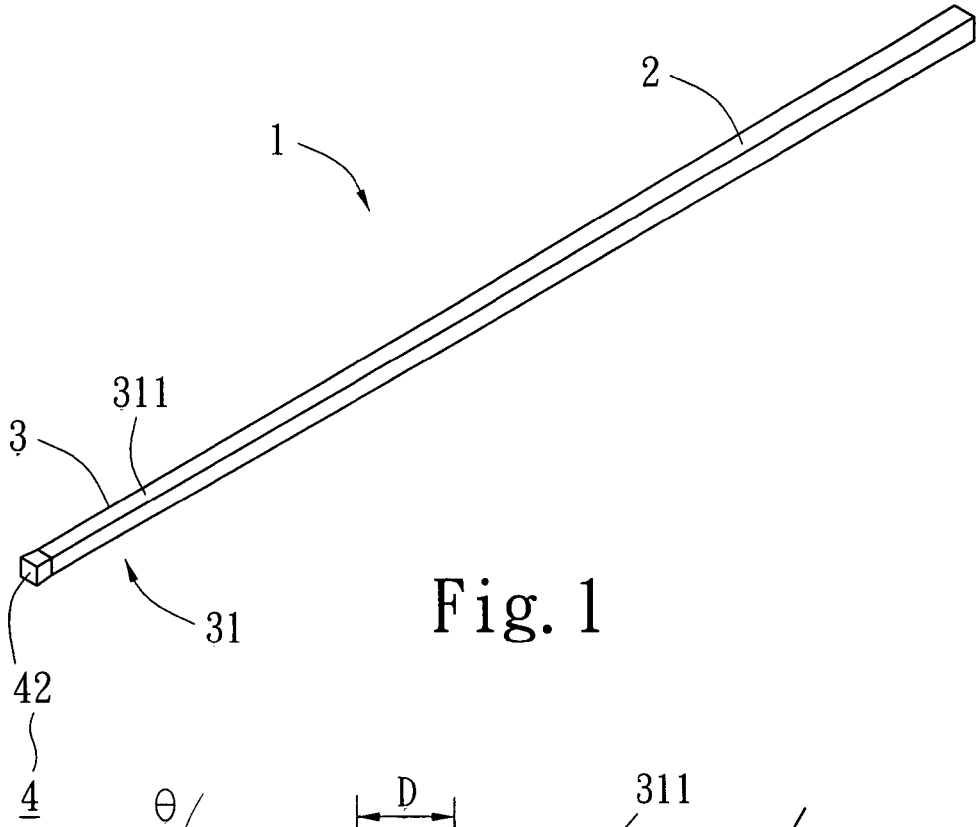
FIG. 1 is a three-dimensional perspective view of the first embodiment according to the invention.
Figure 2:
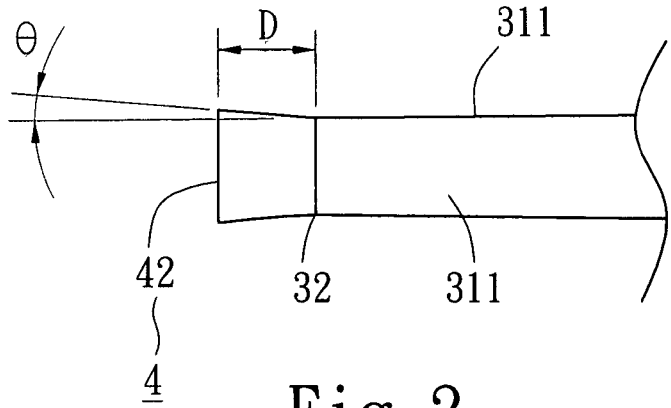
FIG. 2 is a partial enlarged side view of the embodiment of FIG. 1.
Figure 3:
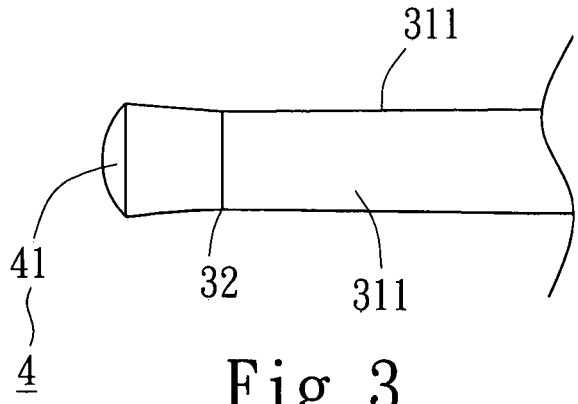
FIG. 3 is a side view showing the convex surface provided on the tail end of the first embodiment according to the invention.

Referring to FIGS. 1 and 2, the chopsticks structure 1 of the first embodiment according to the invention comprises a holding part 2 and a clipping part 3, wherein said holding part 2 and clipping part 3 is configured as a tapered tetragonal column, or a non-tapered tetragonal column having its end surface 4 configured as a flat surface 42 or a convex surface 41, as shown in FIG. 3.

The four side surfaces 311 interconnected along the outer periphery of said clipping part 3 are the outer peripheral surface 31 of the clipping part 3. The tail end of any one of these side surfaces 311 raises outwardly from an initial raising point to form an elevation angle, θ, of 1- 45 degree, preferably of 3- 10 degree. Further, the distance from the initial raising point 32 at the clipping part 3 to the end surface 4 of the clipping part 3 is preferably to be 0.3- 1.0 cm.

Figure 4:
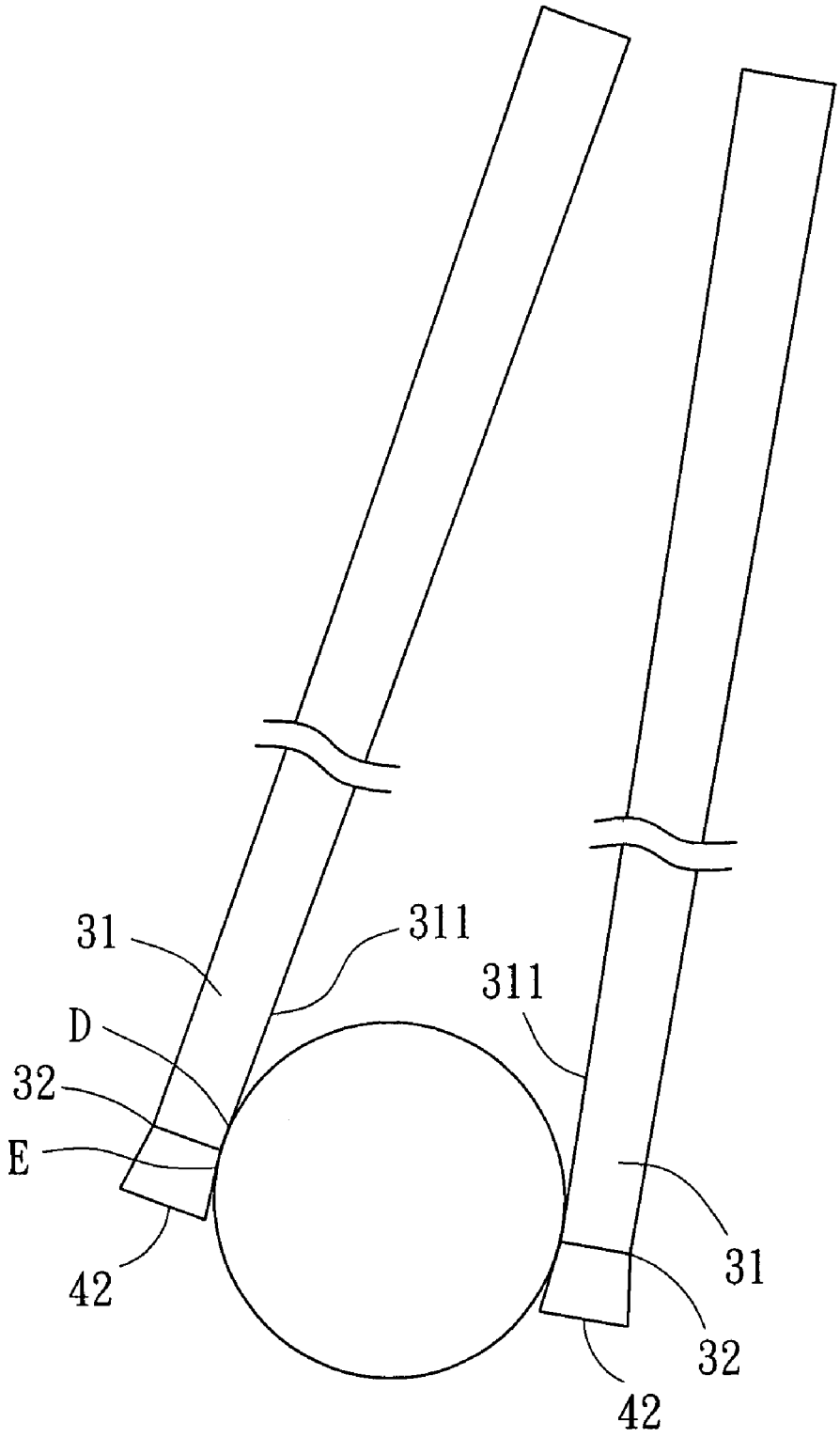
FIG. 4 shows the use state of the first embodiment according to the invention.

Referring to FIG. 4, when a user holds on the holding part 2 while clips an ordinary food with the clipping part 3, he can clip the food as in the case of using a conventional chopsticks structure. While the chopsticks structure according to the invention is used to clip a bulky and food of smooth surface, such as, for example, a cooked egg, one side surface 311 on the clipping part 31 of one chopstick in a set of chopsticks will contact the surface of the egg along line D-E or as interfacial contact, while one side surface 311 on the clipping part 31 of the other chopstick contacts the egg in an opposite direction and applies a corresponding force to clip up the egg readily. Furthermore, one side surface 311 of said clipping part 31 contacts the surface of the egg in a large area such that the egg can be securely hold without subsequent losing the egg.

Figure 5:
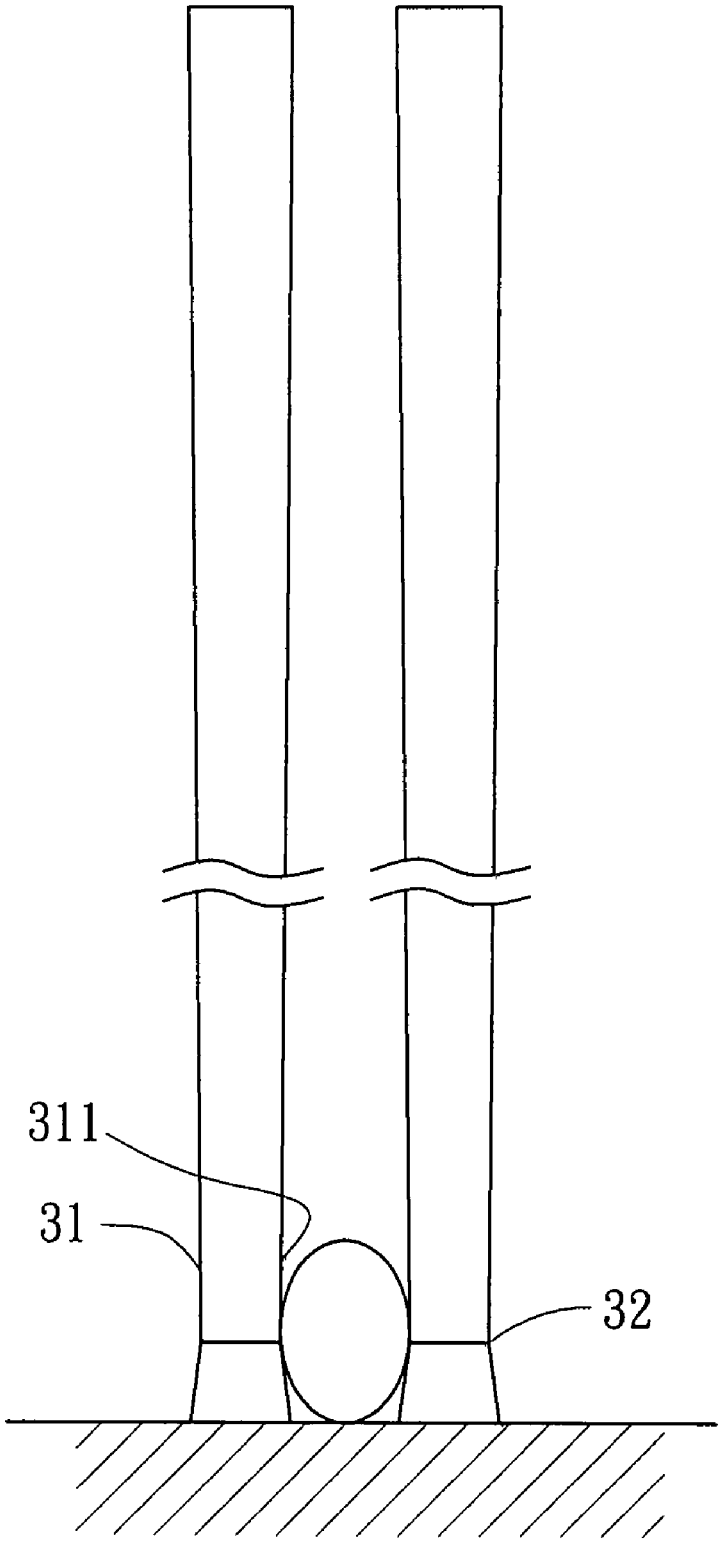
FIG. 5 shows another use state of the first embodiment according to the invention.

When the food to be clipped is a cooked bird's egg or bean food having a small size and smooth surface (as shown in FIG. 5), by using the clipping structure according to the invention, such egg or bean food can be clipped readily, with the clipping effect not affected by the size or shape of the food. In addition, since the tail end surface 4 of the clipping part 3 in the chopsticks structure according to the invention is configured as a flat surface 42 and the distance D between the initial raising point 32 of the clipping part 3 to the end surface 4 of the clipping part 3 is small, these structural features favor the clipping of the food.

Figure 6:
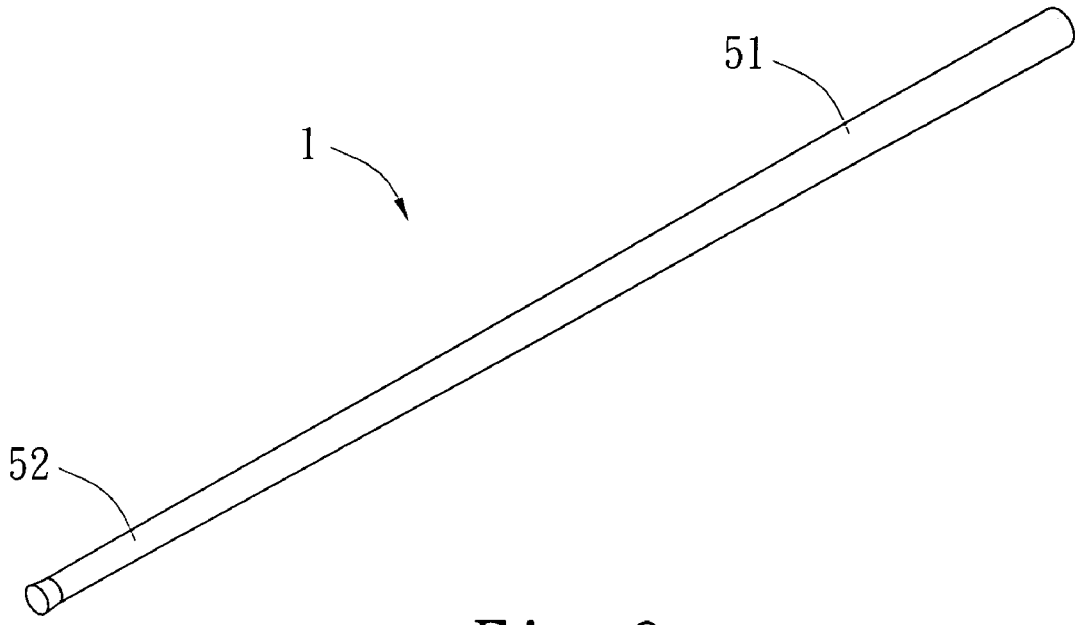
FIG. 6 is a three-dimensional perspective view of the second embodiment according to the invention.
Figure 7:
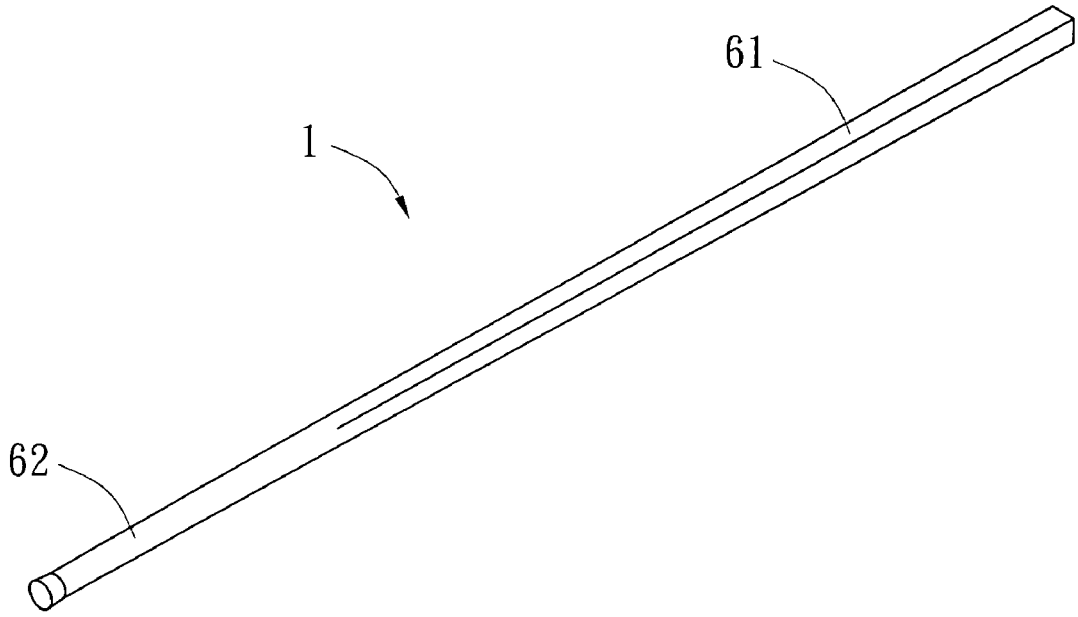
FIG. 7 is a three-dimensional perspective view of the third embodiment according to the invention.
Figure 8:
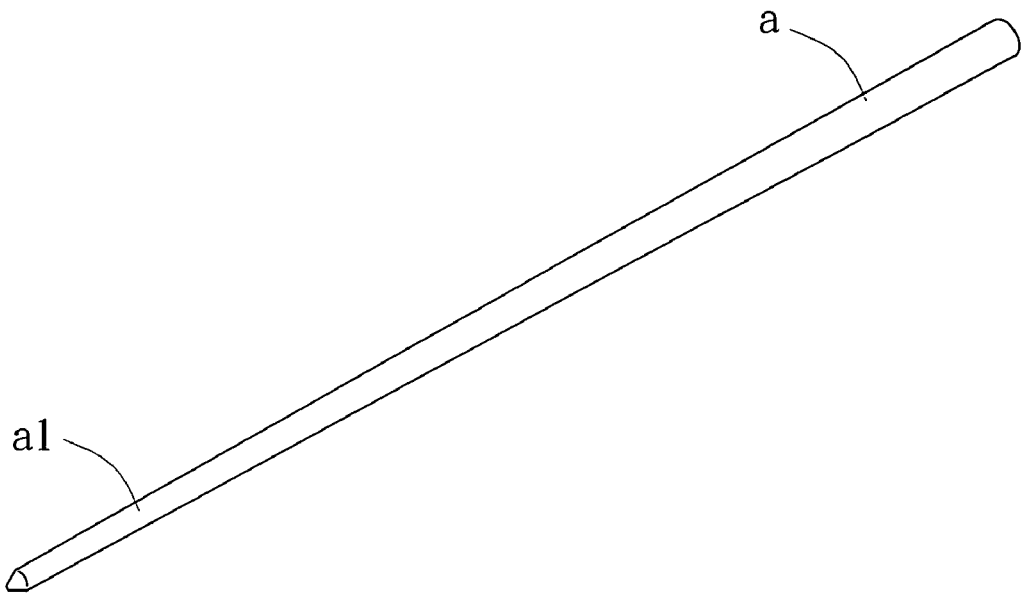
Fig. 8 (Prior Art)
FIG. 8 is a three-dimensional perspective view of conventional chopsticks.
Figure 9:
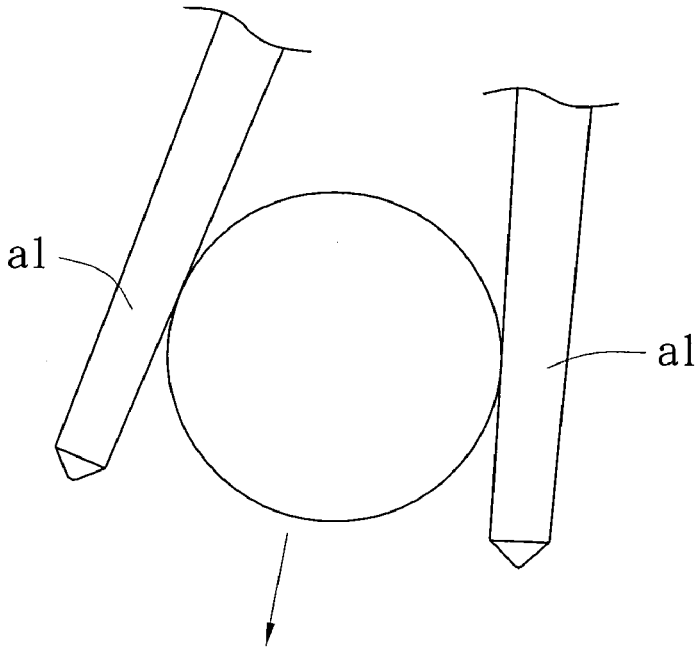
Fig. 9 (Prior Art)
FIG. 9 shows another use state of the conventional chopsticks of FIG. 8.
Figure 10:
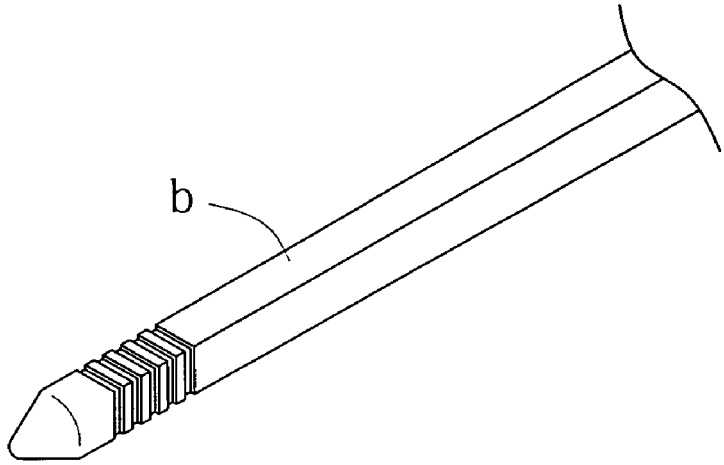
Fig. 10 (Prior Art)
FIG. 10 is a three-dimensional perspective view of another conventional chopsticks.
Figure 11:
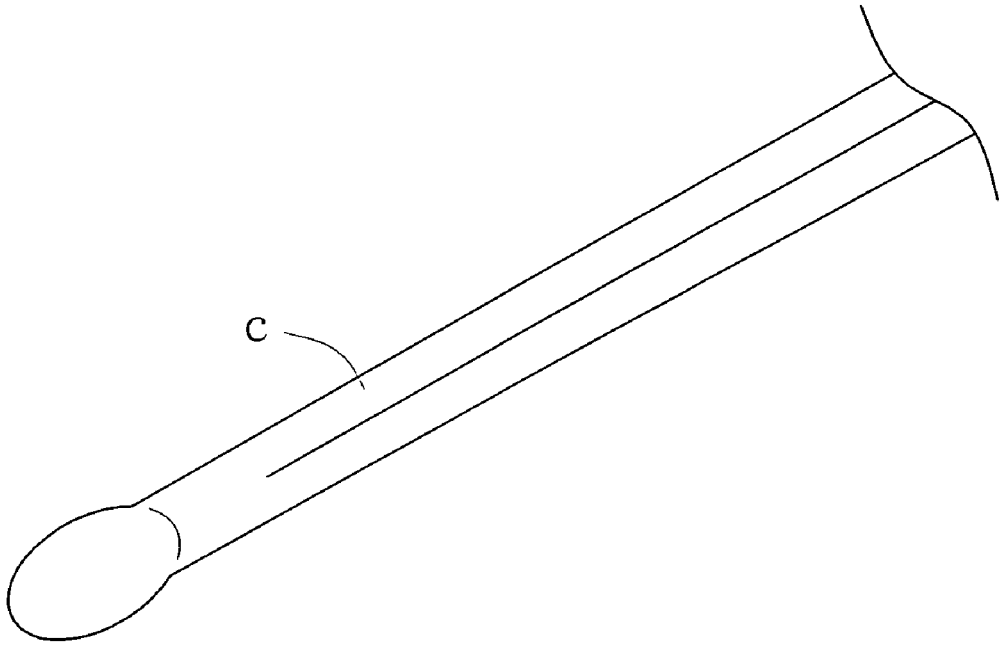
Fig. 11 (Prior Art)
FIG. 11 is a three-dimensional perspective view of another conventional chopsticks having its clipping part as an arc shape.
Figure 12:
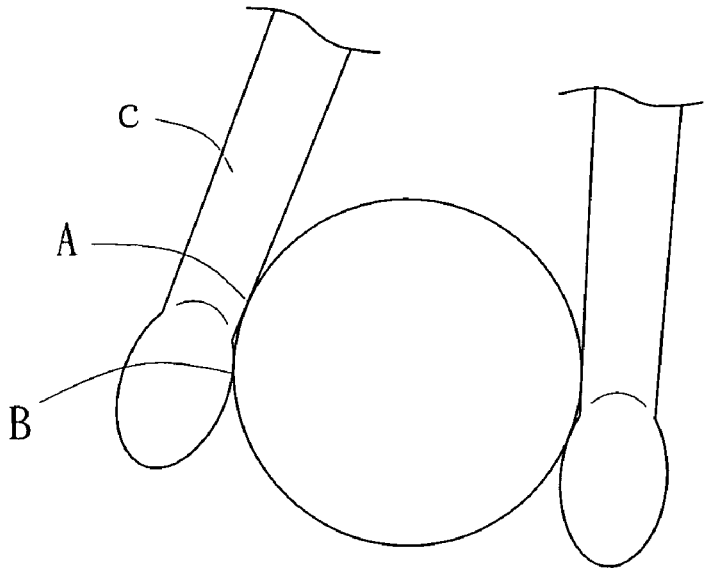
Fig. 12 (Prior Art)
FIG. 12 shows the use state of the conventional chopsticks of FIG. 11.
Figure 13:
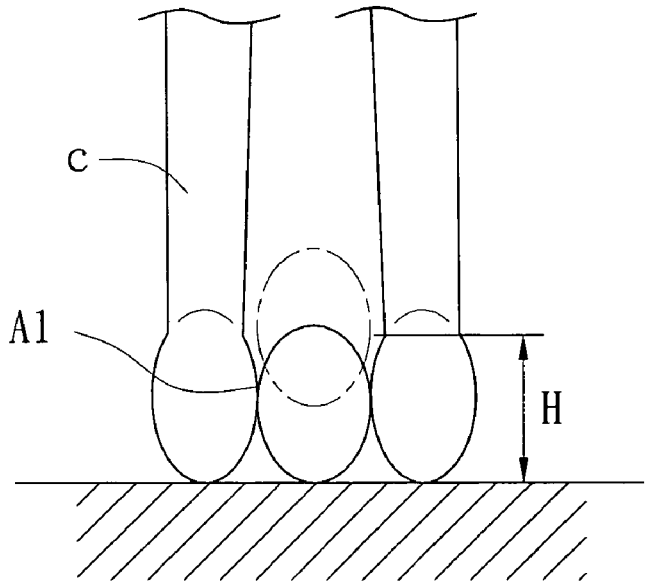
Fig. 13 (Prior Art)
FIG. 13 shows another use state of the conventional chopsticks of FIG. 11.

Referring to FIGS. 6 and 7, showing chopsticks structures 1 of the second and the third embodiments according to the invention, respectively. In the chopsticks structure 1 according to the second embodiment, its holding part 51 and clipping part 52 are tapered cylinder or non-tapered cylinder. Whereas the holding part 61 in the third embodiment is a tetragonal column, while its clipping part 62 is a cylinder. Though perspective structures of these two embodiments are different from that of the first embodiment, the elevation angle formed by raising outwardly the tail end of the outer peripheral surface on their clipping part (52, 62) can increase likewise the fulcrum of the holding force and therefore favor the clipping of food.

Thus, the chopsticks structure according to the invention has following advantages:

1. The clipping part provided on the chopsticks structure according to the invention can clip various foods of smooth surface with diverse size by contacting through multiple points, lines or faces between surfaces of the clipping part and the surface of those food.
2. When the chopsticks structure of the invention is used, since the contact area between the holding part on such structure and the food, the food can be clipped securely thereby without subsequent losing the food.

In summary, based on the foregoing disclosure, the intended objectives can be achieved by the invention by providing a chopsticks structure that can increase the fulcrum of the holding force and the contact area between the clipping part and the food to favor the clipping of foods with diverse sizes. Accordingly, the chopsticks structure according to the invention exhibits industrial utility, and deserves a patent right.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A chopsticks structure, comprises a holding part and a clipping part, with the following improvements:

an outer peripheral surface of said clipping part raising outwardly from an initial raising point toward an end surface of said clipping part forming an angle, θ, of 1-45 degree defined by a degree of outward deviation from a length of said holding part, which increases a fulcrum of the holding force during clipping food by providing at least two contact points between said clipping part and said food, wherein one contact point is located on said outer peripheral surface of said clipping part and another contact point is located at an end of said holding part in a position both abutting said one contact point and adjacent said clipping part.

2. A chopsticks structure as in claim 1, wherein the angle, θ, is in a range of 3-10 degree.

3. A chopsticks structure as in claim 2, wherein the distance from the initial raising point of said clipping part to the end surface of the clipping part is between 0.3 and 1.0 cm.

4. A chopsticks structure as in claim 1, wherein the distance from the initial raising point of said clipping part to the end surface of the clipping part is between 0.3 and 1.0 cm.

5. A chopsticks structure as in claim 1, wherein said clipping part is in a shape of tetragonal column.

6. A chopsticks structure as in claim 1, wherein said holding part is in a shape of a tetragonal column.

* * * * *